United States Patent [19]

Guyer et al.

[11] 4,062,721

[45] Dec. 13, 1977

[54] USE OF SURFACTANT TO INCREASE WATER REMOVAL FROM FIBROUS WEB

[75] Inventors: Vernon L. Guyer, Minneapolis; David O. Bringen, Edina, both of Minn.

[73] Assignee: Conwed Corporation, St. Paul, Minn.

[21] Appl. No.: 735,428

[22] Filed: Oct. 26, 1976

[51] Int. Cl.[2] ..... D21D 3/00

[52] U.S. Cl. ..... 162/101; 162/145; 162/152; 162/175; 162/184

[58] Field of Search ..... 162/145, 152, 183, 101, 162/184, 202

[56] References Cited

U.S. PATENT DOCUMENTS

| | | | |
|---|---|---|---|
| 2,054,630 | 9/1936 | Hurrey | 162/202 |
| 3,300,372 | 1/1967 | Baur | 162/145 |
| 3,510,394 | 5/1970 | Cadotte | 162/145 |
| 3,542,640 | 11/1970 | Friedberg et al. | 162/101 |
| 3,716,449 | 2/1973 | Gatward et al. | 162/101 |

OTHER PUBLICATIONS

MacDonald, "Control, Sec. Fiber, Structural Board, Coating", vol. II (1969), pp. 429, 430.

*Primary Examiner*—S. Leon Bashore
*Assistant Examiner*—Peter Chin
*Attorney, Agent, or Firm*—Eyre, Mann, Lucas & Just

[57] ABSTRACT

A surfactant foaming agent added to a wet fibrous sheet just before initiation of vacuum water extraction forms foam within the sheet. The foam expels water from the sheet while increasing the resistance to vacuum. Water removal time is lengthened and the fractional amount of water removed by suction is increased. The reduced residual water provides a proportional decrease in drying time and drying energy.

The addition of an anti-foaming agent with the surfactant reduces the water drainage time as compared to the normal case. This increases the drainage rate but does not increase the amount of water drained from the sheet.

6 Claims, 2 Drawing Figures

USE OF SURFACTANT TO INCREASE WATER REMOVAL FROM FIBROUS WEB

BACKGROUND OF THE INVENTION

In the production of fire retardant felted mineral fiber panels, an aqueous slurry typically comprising mineral wool, clay and starch is dewatered on the screen of a Fourdrinier machine. U.S. Pat. No. 3,510,394 discloses the use of flocculent materials in the water to prevent the dispersal and loss of starch and clay with the drainage water.

The prior art contains numerous examples of mechanically produced aerated foam in the aqueous slurry. The foam prevents the stratification of materials during drainage. Although the foam successfully retains the particles in a space matrix without significant stratification, the presence of mechanically produced foam increases water drainage time beyond the limits of practical production rates.

SUMMARY OF THE INVENTION

The present invention teaches the addition of a surfactant foaming agent to the furnish after the furnish is in the flow box in order that minimal foam is present in the sheet as it is laid on the wire of a Fourdrinier machine and during an initial gravity drainage period. It has been found that the presence of the surfactant foaming agent has no noticeable effect on the drainage rate during gravity drainage.

After a short period of gravity drainage, a vacuum is created across the wet sheet. Foam is observed to form within the sheet caused by the agitation of air being drawn through the sheet. The air pressure differential developable across the sheet is increased and the vacuum drainage process is observed to be substantially improved as compared to the case without the surfactant. The amount of water remaining is typically reduced from about 65% to about 50% by weight of the wet sheet at the end of drainage. This approximately 20% reduction in water from the wet sheet reduces the drying time and drying energy required.

When an anti-foaming agent is added to the furnish with the surfactant, the overall reduction in water surface tension causes the drainage time to be decreased. However, the anti-foaming agent is detrimental in that the fractional amount of water removed is not increased.

THE FIGURES

DETAILED DESCRIPTION OF THE PREFERRED EMBODIMENT

Figure 1:
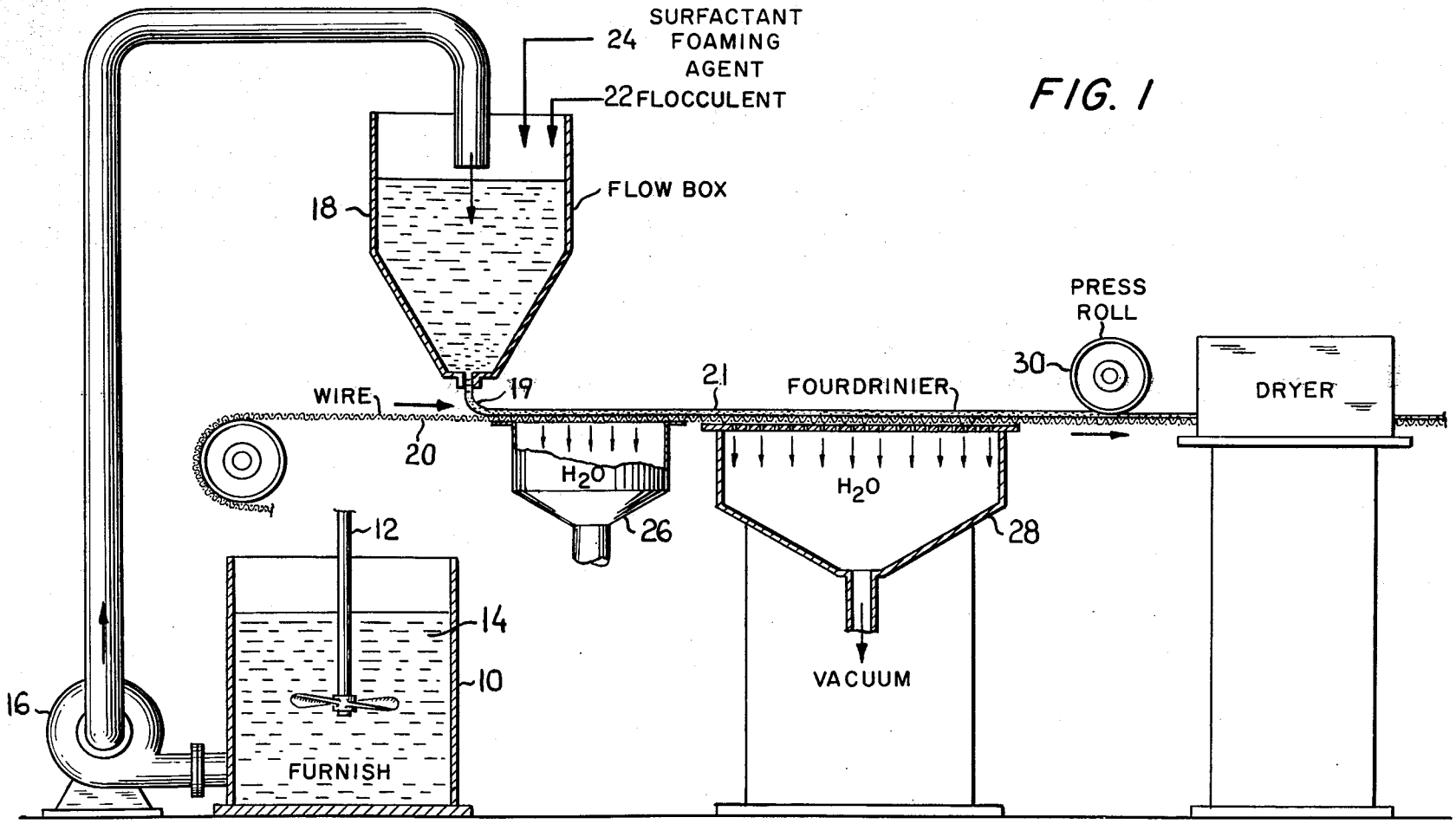
FIG. 1 is a schematic diagram of a mineral board manufacturing process.

The following description should be read with reference to FIG. 1 which shows simplified schematic diagram of a mineral board manufacturing process in accordance with the present invention.

A mixing tank 10 containing a motor driven impeller 12 mixes and homogenizes an aqueous slurry 14 containing from 3 to 6 percent solids. Of the solids, the composition of the slurry 14 should be between the following limits:

| | Percent | |
|---|---|---|
| | Max | Min |
| Mineral wool | 95 | 25 |
| Newsprint or other cellulose fibers | 15 | 0 |
| Clay | 25 | 0 |
| Starch | 15 | 5 |
| Perlite | 40 | 0 |

A mixture which has been found to give satisfactory results is as follows:

| Component | Percent |
|---|---|
| Mineral Wool | 71% |
| Stratton Clay | 12% |
| Starch | 12% |
| Perlite | 4% |
| Miscellaneous | 1% |

A number of prior U.S. Patents teach the addition of a foaming agent to the slurry 14 in the mixing tank 10. As will appear, this procedure gives unsatisfactorily long drainage times to maintain a satisfactory production rate.

A pump 16 transfers the slurry from the mixing tank 10 to a flow box 18. The function of the flow box 18 is to spread a uniform layer of slurry 19 across the width of a moving wire belt 20, called the wire, to form a wet sheet 21. The wet sheet 21 is preferably of a thickness to yield a finished product having a thickness between $\frac{1}{4}$ and $1\frac{1}{4}$ inches. In the embodiment shown, a flocculent 22 and a surfactant foaming agent 24 are added to the relatively non-turbulent slurry in the flow box 18. Depending on the choice of materials, the flocculant 22 and surfactant foaming agent 24 may be a single material or they may be separate materials added simultaneously or separately. The surfactant foaming agent 24 is preferably added in the proportion of 0.01 to 0.1 percent to the solids with best results being obtained with a proportion between 0.02 and 0.05 percent. In whatever manner the surfactant 24 is added, it is important to the correct functioning of this invention that there be substantially no foaming when the layer of slurry 19 is deposited on the wire 20.

A gravity drainage region 26 allows initial discharge of water from the wet sheet 21 through the mesh of the wire 20. Approximately 85 percent of the water removed from the slurry before drying is removed in the gravity drainage region 26.

The moving wire 20 then carries the wet sheet 21 over one or more vacuum boxes 28. The vacuum box 28 is connected to a vacuum pump such that additional water is drawn from the wet sheet 21. The interior of the wet sheet 21 is observed to contain foam at this time. The foam is generated by the air being drawn through the wet sheet 21. In the baseline mixture, it was determined that the addition of a surfactant sold under the trade name Triton X-100, increased the drainage time from 8 to 10 seconds while reducing the amount of water remaining in the board from 62.5 to 51.2 percent. Triton X-100 is a non-ionic linear alkylene sulforate available from the Rohm & Haas Co. of Philadelphia. When a foaming agent is added in the mixing tank 10 and mechanically agitated and aerated to form foam before spreading, the drainage time is increased to 30 seconds and it has been observed that the amount of water which drains off is reduced as compared to the baseline mixture without the foaming agent.

It is believed that the increase in water removal in the present invention is influenced by the fact that the bubbles formed in the interior of the wet sheet 21 enable a higher pressure differential to be developed across it. For example, the baseline mixture without the surfactant foaming agent achieved a pressure differential of 3.5 inches of mercury whereas the baseline mixture with the surfactant foaming agent achieved a pressure differential of 8 inches of mercury. The pressure differential can be taken as a pragmatic measure of board porosity. The preceding change in pressure differential indicates that the presence of the bubbles reduces the gross porosity of the board thus making vacuum more effective in removing the water. It is to be understood that the correctness or incorrectness of this theory is of no moment to the claimed invention and that it is merely set forth as a hypothesis.

After being carried past the vacuum box 28, the wet sheet 21 may pass under a press roll 30. The press roll 30 may smooth the surface of the wet sheet 21, reduce its thickness and press out additional water. The wet sheet is then carried into a dryer 32 where elevated temperatures are employed to remove the remaining moisture from the wet sheet 21 in order to rigidify the sheet.

Figure 2:
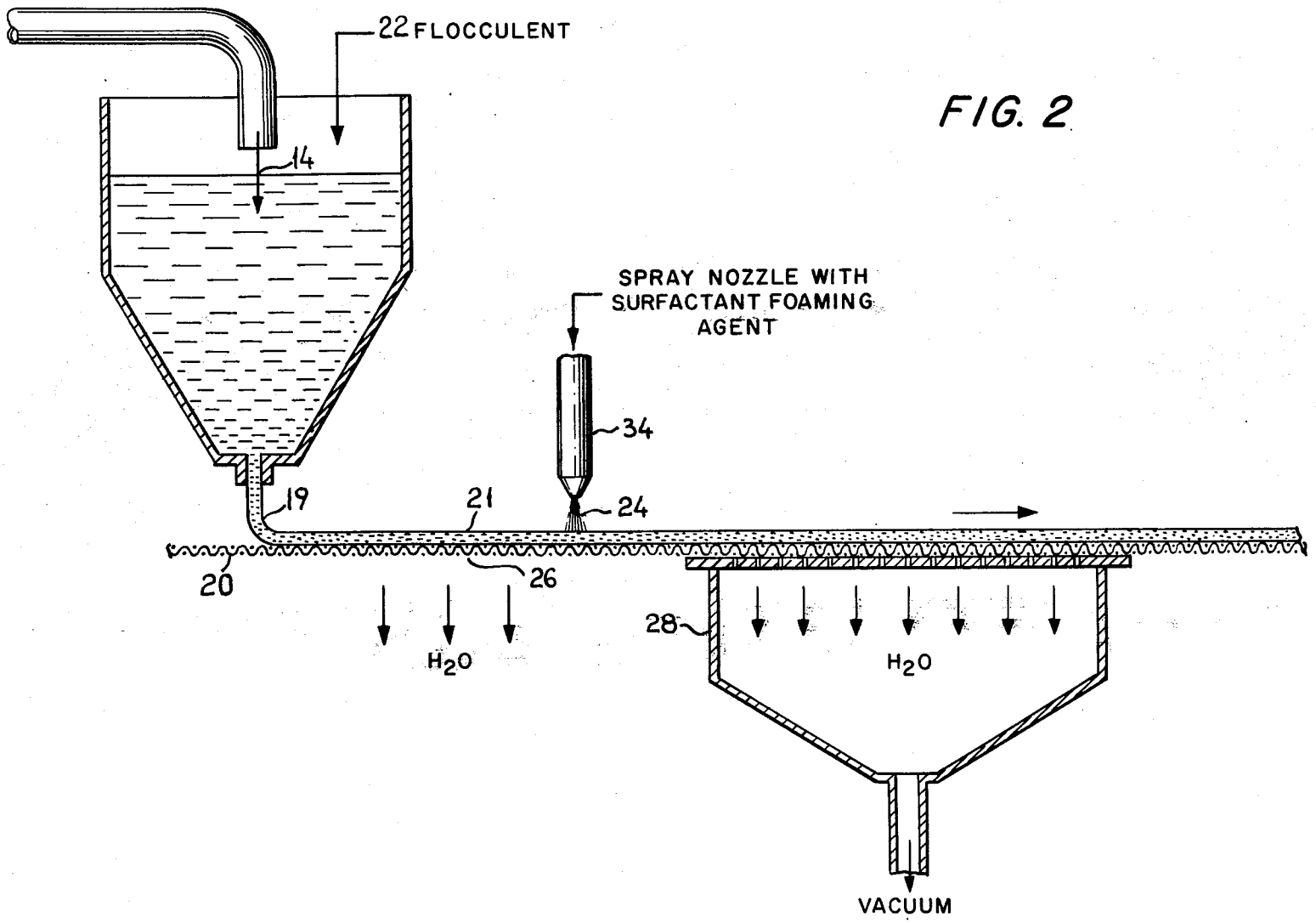
FIG. 2 is an alternative embodiment of apparatus for carrying out the present invention.

The importance of avoiding substantial foaming until the wet sheet 21 reaches the vacuum box 28 has been discussed in the preceding. It has been found that adding the surfactant foaming agent 24 in the flow box 18 may still allow the undesired generation of some deleterious foam before or during the deposition of the slurry 19 on the wire 20. FIG. 2 shows an alternative embodiment of the invention which helps to avoid premature foaming. The aqueous slurry 14 and flocculant 22 are mixed in the flow box 18 but the surfactant foaming agent is not added at this time. Thus when the layer of slurry 19 is deposited on the wire 20, the slurry 19 does not contain material which can cause foaming to occur.

A linear spray nozzle 34 is disposed with its long dimension across the width of the wet sheet 21 above the gravity drainage region 26. The spray nozzle 34 deposits a surfactant foaming agent 24 across the width of the wet sheet 21. Thus, as the wet sheet 21 reaches the vacuum box 28, some of the foaming agent 24 has penetrated the wet sheet 21. The inward passage of air due to the vacuum draws any remaining foaming agent 24 into the wet sheet 21 while at the same time providing the mechanical agitation and aeration required to form the foam.

A series of 20 experiments were performed to determine the effectiveness and sensitivity of the invention in enhancing water removal. The experiments were performed on three furnish mixtures. The A furnish was previously identified as the baseline mixture. The three furnishes tested were as follows:

| Material | Percent by Weight A | B | C |
|---|---|---|---|
| Mineral wool | 71 | 61 | 52 |
| Newsprint | — | 10 | 15 |
| Perlite | 4 | 16 | 20 |
| Starch | 12 | 12 | 12 |
| Clay | 12 | — | — |
| Gendriv 162 (0.5% 50/N | 0.08 | 0.08 | 0.08 |
| Miscellaneous | .92 | .92 | .92 |

*Gendriv 162 is a cationic flocculating agent consisting essentially of guar gum modified with quaternary amine sold by General Mills. Any equivalent flocculating agent among types well known in art, such as, Hydroid 780 produced by Merck and identified as a cationic polyacrylamide, may be used.

A summary of the water discharge performance of the three furnishes with and without a surfactant foaming agent is given in the following tabulation:

SUMMARY OF WATER DISCHARGE PERFORMANCE

| Furnish | Surfactant Foaming Agent | Unpressed Wt., g. | % Solids | % Water | % Reduction in Water | Oven Dry Wt., g. |
|---|---|---|---|---|---|---|
| A | None | 617 | 35.0 | 65.0 | 21.2 | 216 |
| | TX-100* | 422 | 48.8 | 51.2 | | 206 |
| B | None | 798 | 23.2 | 76.8 | 14.9 | 185 |
| | TX-100 | 635 | 29.5 | 70.5 | | 187.5 |
| C | None | 782 | 21.7 | 78.3 | 3.7 | .70 |
| | TX-100 | 674 | 24.6 | 75.4 | | 166 |

*TX-100 is Triton X-100; 1 to 2 grams per board

The reduced effectiveness of the surfactant foaming agent in furnishes B and C is believed to be due to the greater quantity of perlite found in these furnishes. The perlite increases the porosity of the board and thereby decreases the ability of the surfactant foaming agent to expel water.

A summary of the 20 experiments is given in the following tabulation. Note that the first two experiments under each furnish correspond to the tabulation of water discharge performance immediately preceding.

SUMMARY OF EXPERIMENTS

| Experiment No. | Additive & Level | Time In Flow Box | Drain Time Sec. | Unpressed Wet Sheet Wt. g | Unpressed Wet Sheet % Solids | Presence of Foam | Residual Vacuum IN Hg |
|---|---|---|---|---|---|---|---|
| | Furnish: A | | | | | | |
| 1 | Control (no additive) | — | 8 | 541 | 37.5 | No | 3.5 |
| 2 | Triton X-100; 2.5% (nonionic) | 60 SEC | 10 | 422 | 48.8 | Yes | 8.0 |
| 3 | Triton X-100; 2.5% Troykd 666 Anti foam; 2.5 | 60 SEC | 6.5 | 543 | 38.3 | No | 3.8 |
| 4 | Triton X-100; 2.5% | 60 SEC | 9.5 | 423 | 49.8 | Yes | 8.2 |
| 5 | Triton X-100; 2.5% | 20 MIN | 15 to 20 | 406 | 52.0 | Yes | 7.8 |
| 6 | Triton W-30 (anionic) 2.5% | 60 SEC | 7.5 | 602 | 35.5 | No | 3.5 |
| 7 | Triton CF-32 (non-ionic) 2.5% | 60 SEC | 7.5 | 584 | 35.5 | No | 3.5 |
| 8 | Triton X-405 (cationic) 2.5% | 60 SEC | 10 | 418 | 49.8 | Yes | 8.5 |
| 9 | Carboxymethyl Cellulose 2.5% | 20 MIN | 9 | 636 | 32.3 | No | 3.8 |
| 10 | Carboxymethyl Cellulose 5.0% | 20 MIN | 31 | 800 | 26.5 | No | 4.5 |
| 11 | Igepal Co - 630 0.6% | 60 SEC | 9.5 | 476 | 44.8 | Yes | — |

-continued

SUMMARY OF EXPERIMENTS

| Experiment No. | Additive & Level | Time In Flow Box | Drain Time Sec. | Unpressed Wet Sheet Wt. g | Unpressed Wet Sheet % Solids | Presence of Foam | Residual Vacuum IN Hg |
|---|---|---|---|---|---|---|---|
| 12 | Igepal Co - 630 2.5% | 60 SEC | 8.5 | 417 | 50.5 | Yes | — |
| 13 | Igepal Co - 630 6.5% | 60 SEC | 10.5 | 415 | 51.6 | Yes | — |
| | Furnish:B | | | | | | |
| 14 | Control (no additive) | — | 8.5 | 798 | 23.2 | No | 3.5 |
| 15 | Triton X-100 1% | — | — | — | 29.5 | Yes | — |
| 16 | "Joy" Detergent; 1.25% | 30 SEC | 9.5 | 704 | 26.3 | Yes | 4.3 |
| 17 | "Joy" Detergent; 2.5% | 30 SEC | 12 | 588 | 31.5 | Yes | 6.5 |
| 18 | "Joy" Detergent; 5.0% | 30 SEC | 12 | 528 | 34.5 | Yes | 8.0 |
| | Furnish:C | | | | | | |
| 19 | Control (no additive) | — | 11 | 782 | 21.7 | No | — |
| 20 | Triton X-100; 1.1% | 60 SEC | 12 | 674 | 24.5 | Yes | — |

The necessity of producing internal foam is shown by experiment 3 wherein an anti-foaming agent (Troykd 66 antifoam) is added in addition to the surfactant foaming agent. The amount of water discharged is not significantly increased over the control case in experiment 1. Note, however, that the drainage time is decreased from 8 to 6.5 seconds by the addition of the two additives.

Experiments 4 and 5 compare the effectiveness of the surfactant foaming agent which has been added 60 seconds and 20 minutes respectively before deposition. Note that the drainage time is increased by a factor of 1.5 to 2 without a significant difference in water removal. This effect is believed due to the mechanical formation of foam over the lengthy period of experiment 5 which interferes with drainage.

Experiments 6 and 7 test the utility of non-foaming surfactants. When foam is absent there is no noticeable improvement in water removal.

Experiment 8 tests the use of a cationic surfactant foaming agent in place of the non-ionic surfactant foaming agent in experiments 2 through 5. The improvement in water removal with the cationic surfactant is approximately equal to that using the non-ionic surfactant in experiment 2. Although a non-ionic surfactant is preferred because it is believed that it will not interfere with the flocculant, cationic and anionic surfactants may be usefully employed.

Most foaming agents are also surfactants. However, in experiments 9 and 10, carboxymethylcellulose (CMC), which is not a surfactant, was used as a foaming agent. Even though foam was present in the aqueous furnish prior to foaming, there was no evidence of foam in the white water; furthermore, the amount of water retained in the sheet was higher, presumably due to the high water-holding capacity of this hydrophillic gel. At a 5.0% CMC level, the rate of water drainage was exceedingly slow due to the increased viscosity of the water.

Experiments 11 through 13 demonstrate the sensitivity of the process to varying concentrations of a different surfactant foaming agent, in this case Igepal CO-630.

Experiments 14 through 18 and 19 and 20 show various parts of the preceding tests using furnishes B and C respectively.

It will be understood that the claims are intended to cover all changes and modifications of the preferred embodiments of the invention, herein chosen for the purpose of illustration which do not constitute departures from the spirit and scope of the invention.

What is claimed is:

1. A method for removing water from a wet fibrous sheet comprising the steps of:

a. mixing an aqueous slurry comprising mineral wool, a binder;

b. depositing said aqueous slurry on a wire mesh to form a wet sheet;

c. adding a surfactant foaming agent to the slurry, said step of adding said surfactant foaming agent being performed at substantially the time that said slurry is deposited on said wire mesh, whereby essentially no internal foam is present in said wet sheet at the time of depositing;

d. draining water from said wet sheet through said wire mesh, said drainage being aided by the force of gravity; and e. draining additional water from said wet sheet through said wire mesh, said additional drainage being aided by an air pressure differential created across said wet sheet whereby foam is generated within said wet sheet due to the passage of air therethrough.

2. The method of claim 1 wherein said aqueous slurry comprises at least 50 percent mineral wool by dry weight.

3. The method of claim 1 wherein said binder is starch.

4. The method of claim 1 wherein said surfactant foaming agent is added to said aqueous slurry less than about one minute before said aqueous slurry is deposited on said wire mesh.

5. The method of claim 1 wherein said surfactant foaming agent is added to said aqueous slurry after said aqueous slurry has been deposited on said wire mesh.

6. The method of claim 5 wherein the step of adding said surfactant foaming agent is by spraying said surfactant foaming agent on the surface of said wet mat.

* * * * *